US010594030B2

(12) United States Patent
Lee et al.

(10) Patent No.: US 10,594,030 B2
(45) Date of Patent: Mar. 17, 2020

(54) TRUE TIME DELAY MODULE AND BEAM FORMER HAVING PLURAL DELAY LINES SELECTIVELY CONNECTED BY PLURAL SWITCHING ELEMENTS INCLUDING ONE OR MORE INTERMEDIATE SWITCHING ELEMENT

(71) Applicant: General Electric Company, Schenectady, NY (US)

(72) Inventors: Yongjae Lee, Latham, NY (US); Joseph Alfred Iannotti, Glenville, NY (US); Steven YueHin Go, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 452 days.

(21) Appl. No.: 15/421,915

(22) Filed: Feb. 1, 2017

(65) Prior Publication Data

US 2018/0219286 A1 Aug. 2, 2018

(51) Int. Cl.
*H01Q 3/26* (2006.01)
*H01P 1/18* (2006.01)
(Continued)

(52) U.S. Cl.
CPC ..... *H01Q 3/2682* (2013.01); *H01P 1/184* (2013.01); *H01P 9/00* (2013.01); *H01Q 3/30* (2013.01)

(58) Field of Classification Search
CPC .. H01P 1/185; H01P 1/184; H01P 1/18; H01P 9/00; H01Q 3/2682; H01Q 3/30
(Continued)

(56) References Cited

U.S. PATENT DOCUMENTS 5,757,319 A 5/1998 Loo et al.
6,281,838 B1 * 8/2001 Hong ..... H01Q 3/36 333/139
(Continued)

FOREIGN PATENT DOCUMENTS

WO 2014142885 A1 9/2014

OTHER PUBLICATIONS

Schaffner et al., "A Wideband Beam Switching Antenna Using RF MEMS Switches", IEEE Antennas and Propagation Society International Symposium, Jul. 8-13, 2001, pp. 658-661.
(Continued)

*Primary Examiner* — Benny T Lee
(74) *Attorney, Agent, or Firm* — Ziolkowski Patent Solutions Group, SC; Jean K. Testa

(57) ABSTRACT

A true time delay (TTD) module includes a substrate and a transmission line formed on the substrate. The transmission line includes time delay lines that define signal paths of varying lengths between a signal input and a signal output of the TTD module. A plurality of switching elements are positioned along the transmission line and are selectively controllable to define a signal transmission path between the signal input and the signal output. The switching elements include an input switching element positioned at a first end of each of the plurality of time delay lines, an output switching element positioned at a second end of each of the plurality of time delay lines, and at least one intermediate switching element positioned between the input switching element and the output switching element of at least one of the plurality of time delay lines.

20 Claims, 5 Drawing Sheets

(51) Int. Cl.
*H01Q 3/30* (2006.01)
*H01P 9/00* (2006.01)

(58) Field of Classification Search
USPC ..... 333/164, 139
See application file for complete search history.

(56) References Cited

U.S. PATENT DOCUMENTS 6,307,519 B1 10/2001 Livingston et al.
6,320,481 B1 * 11/2001 Sharma ..... H01P 1/18 333/159
6,650,291 B1 11/2003 West et al.
6,741,207 B1 * 5/2004 Allison et al. ..... H01P 1/184 333/164
7,570,133 B1 * 8/2009 Taft et al. ..... H01P 1/184 333/156
2002/0075094 A1 6/2002 Bechtle et al.
2005/0068123 A1 3/2005 Denatale et al.
2009/0027268 A1 1/2009 Coward

OTHER PUBLICATIONS

Shin et al., "Optical True Time-Delay Feeder for X-band Phased Array Antennas Composed of 2 x 2 Optical MEMS Switches and Fiber Delay Lines", IEEE Photonics Technology Letters, vol. 16, No. 5, May 2004, pp. 1364-1366.
Liang et al., "MEMS Based True Time Delay Technology for Phased Antenna Array Systems", Proceedings of Asia-Pacific Microwave Conference 2007, Dec. 1-14, 2007, pp. 1-4.
Dey et al., "Reliability Analysis of Ku-Band 5-bit Phase Shifters Using MEMS SP4T and SPDT Switches", IEEE Transactions on Microwave Theory and Techniques, vol. 63, No. 12, Dec. 2015, pp. 3997-4012.

* cited by examiner

-RELATED ART-

TRUE TIME DELAY MODULE AND BEAM FORMER HAVING PLURAL DELAY LINES SELECTIVELY CONNECTED BY PLURAL SWITCHING ELEMENTS INCLUDING ONE OR MORE INTERMEDIATE SWITCHING ELEMENT

GOVERNMENT LICENSE RIGHTS

This invention was made with Government support under grant number FA9453-09-C-0305 awarded by the Air Force Research Laboratories. The Government has certain rights in the invention.

BACKGROUND OF THE INVENTION

Embodiments of the invention relate generally to true time delay (TTD) beam formers for an electrically steerable array antenna or phased array antenna, and more particularly to TTD beam former modules incorporating radio frequency (RF) micro-electromechanical systems (MEMS) switches.

Electronically steered antenna (ESA) systems or phased array antenna (PAA) systems combine the signals from multiple stationary antenna elements to point a beam of radio waves at a certain angle in space. The characteristics and angle of the beam is controlled in a manner that electronically steers the beam in different directions without physically moving the antennas. The electronic beam steering in a phased array antenna may be accomplished in one of two ways: through the use of phase shifters and by performing true time delay (TTD). TTD beam steering differs from a phase shifter type approach in the inherent bandwidth of the device and the fact that the device imparts a time delay rather than a phase shift. These distinctions allow the TTD device to be used in very wideband applications for forming antenna beams and nulls. This is advantageous for electronic warfare systems and broadband communication applications.

Beam steering via TTD is accomplished by changing the excitation time of each antenna element. A TTD module is fabricated with high speed switches coupled to transmission lines of various lengths. The amount of time it takes for a signal to be transmitted between the electronics and the antenna is controlled by selecting a particular combination of transmission lines, which imparts a desired amount of phase or time delay on the RF signal. Selection of the transmission lines may be accomplished using different types of switching elements, including utilize RF MEMS, which provide beneficial isolation and insertion loss properties that are advantageous for implementing in TTD applications. These RF MEMS switches use an electrically actuated mechanical movement to achieve an open circuit or a closed circuit in a RF transmission line. When the RF MEMS device is in an on-position, the RF transmission line is "closed" and the RF MEMS device can be used to transmit a high-frequency RF signal.

Despite the performance benefits resulting from the incorporating individual RF MEMS switches into ESA or PAA systems, the development of a small, low power, broadband antenna systems has proven to be a considerable challenge. Existing ESA and PAA systems utilize high power dissipation technology for the phase shifting, power combining, amplifiers, and signal conversion components provided within the system. Use of these components results in complex, costly, and heavy system architecture that has high thermal dissipation and is not suitable for highly miniaturized mobile communication applications.

Additionally, TTD modules may experience interference between the individual signal transmission lines, which degrades the beam steering performance of the TTD module. Such interference is especially prevalent in TTD modules utilized in broadband frequency signal processing applications as a result of the large number of transmission lines utilized to achieve the desired delay. An 8-bit TTD module, for example, requires 256 states, among which the long electrical length typically causes half wavelength (i.e., $\lambda/2$) resonances. These resonances occur at the selected signal line that is switched "ON" to accomplish the desired delay time and at the neighborhood transmission line that is switched off as a result of electromagnetic coupling. This coupling causes an undesirable "suckout" resonance in the selected states and results in poor signal transmission at particular beam states within the frequency band. While amplifiers can be added to improve signal performance, doing so adds undesirable size and cost to the phased array antenna system.

Therefore, it would be desirable to design a TTD beam former module with low RF insertion loss that effectively eliminates unwanted bandstop resonances and maintains good signal transmission for broadband frequency signal processing applications. It would also be desirable for such a TTD beam former to enable fabrication of a low cost, small-scale, and lightweight ESA or PAA system.

BRIEF SUMMARY OF THE INVENTION

In accordance with one aspect of the invention, a true time delay (TTD) module includes a substrate and a transmission line formed on the substrate. The transmission line includes a plurality of time delay lines that define signal paths of varying lengths between a signal input of the TTD module and a signal output of the TTD module. A plurality of switching elements are positioned along the transmission line and are selectively controllable to define a signal transmission path between the signal input and the signal output. The plurality of switching elements include an input switching element positioned at a first end of each of the plurality of time delay lines, an output switching element positioned at a second end of each of the plurality of time delay lines, and at least one intermediate switching element positioned between the input switching element and the output switching element of at least one of the plurality of time delay lines.

In accordance with another aspect of the invention, a method of manufacturing a true time delay (TTD) module includes patterning a signal line on a substrate, the signal line comprising a plurality of delay lines defining alternative paths between a signal input and a signal output of the TTD module. The method also includes forming a first switching device at an input end of each of the plurality of delay lines and forming a second switching device at an output end of each of the plurality of delay lines. At least one intermediate switching device is formed on at least one of the plurality of delay lines between the first switching device and the second switching device. The at least one intermediate switching device divides the respective delay line into a plurality of electrically isolated segments when the at least one intermediate switching device is in an OFF state.

In accordance with yet another aspect of the invention, a beam forming system includes an antenna comprising a plurality of antenna elements and a plurality of dies constructed to transmit a true time delayed (TTD) signal to the plurality of antenna elements. Each die of the plurality of dies includes a base substrate, a transmission line formed on the base substrate, a pair of switching elements positioned at opposing ends of each of the plurality of delay lines, and an intermediate switching element positioned on at least one of the plurality of delay lines between a respective pair of switching elements. The transmission line includes a plurality of delay lines defining alternative signal paths between a signal input and a signal output of the die. The intermediate switching element divides the respective delay line into a plurality of electrically isolated segments when the intermediate switching element is in an open position.

These and other advantages and features will be more readily understood from the following detailed description of preferred embodiments of the invention that is provided in connection with the accompanying drawings.

BRIEF DESCRIPTION OF THE DRAWINGS

The drawings illustrate embodiments presently contemplated for carrying out the invention.

In the drawings.

DETAILED DESCRIPTION OF THE INVENTION

Embodiments of the invention provide for a true time delay (TTD) module useable in a beam forming or beam steering application such as a phased array antenna (PAA) system or electrically steerable antenna (ESA) system. The TTD module is operable across the entire Ku-frequency band and is designed in a manner that eliminates the undesirable electromagnetic coupling that occurs between individual states or incremental delay lines of the module package. The TTD module also has low insertion losses in the range of approximately 2 dB. As described in more detail below, the TTD module includes high speed switching elements, such as micro-electromechanical systems (MEMS) devices, which are inserted along one or more relatively long transmission lines. These switching devices are turned off when the given transmission line is open, thus breaking the long line into smaller segments. In this way, the resonant frequency is pushed higher than the frequency band of interest and undesirable suckout resonances are avoided.

Figure 1:
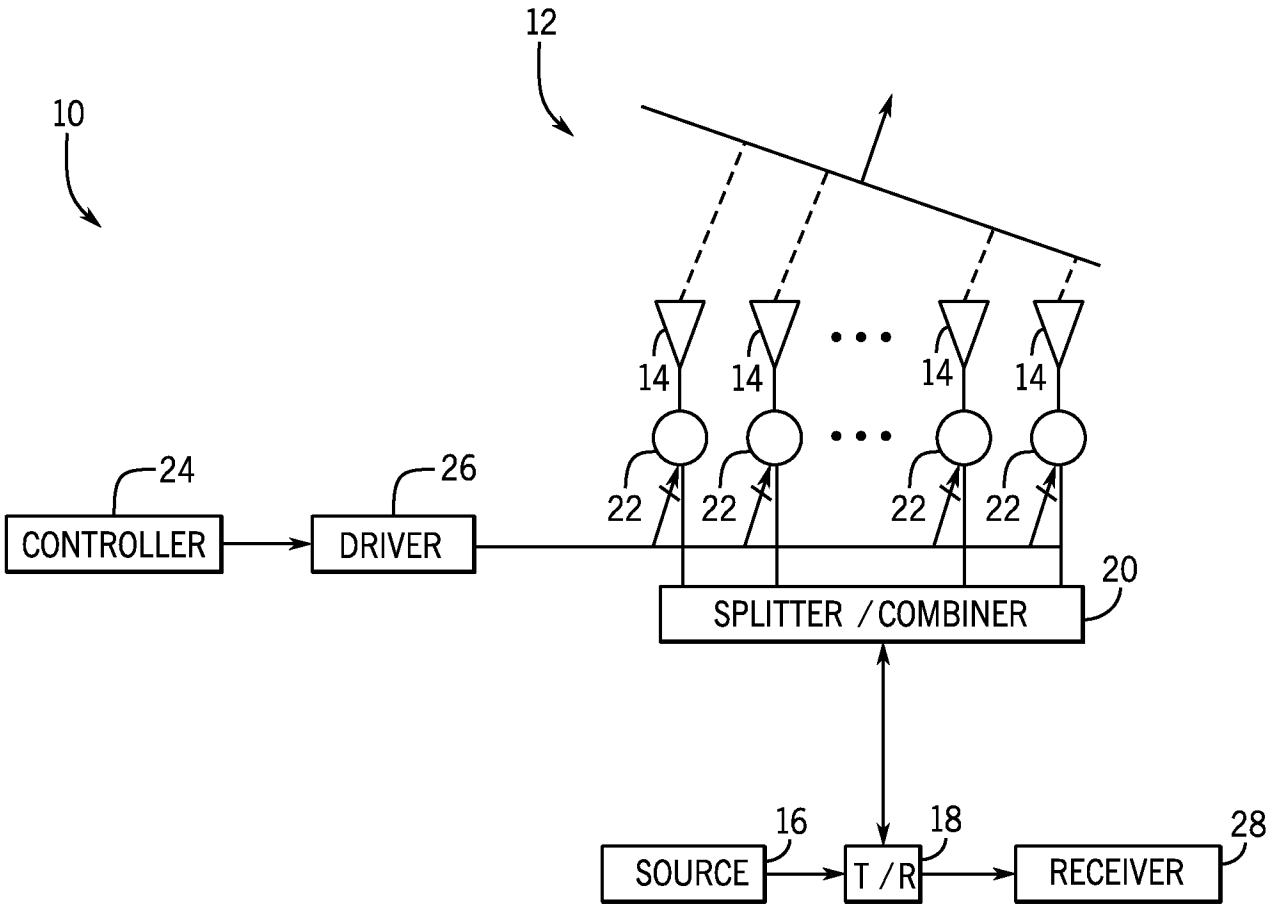
FIG. 1 is a simplified schematic diagram of a radar system with a phased array antenna having beam steering effected with true time delay.

Referring first to FIG. 1, a simplified schematic diagram of a radar system 10 is illustrated according to an embodiment of the invention. The radar system 10 includes an antenna 12 constructed of multiple radiating elements 14 for transmitting and receiving signals. These radiating antenna elements 14 are fed by a source 16 that provides an RF input such as RF modulated signal having a predetermined wavelength. This RF input is transmitted by a transmit/receive (T/R) switch 18 through a splitter/combiner 20 to a true time delay (TTD) beam former or module 22 corresponding to each antenna element 14. A controller 24 provides drive signals to a driver die 26, which selectively controls switching elements within the TTD module 22 in a manner that generates a time delayed signal. These TTD modules 22 output the time delayed signal to a respective antenna element 14. Signals received by antenna elements 14 are transmitted through splitter/combiner 20 to a receiver 28. While not specifically illustrated in FIG. 1, it is contemplated that embodiments of the invention may be configured for independent beam control of the vertical and horizontal polarizations and include separate beam controlling circuitry for each polarization.

Figure 2:
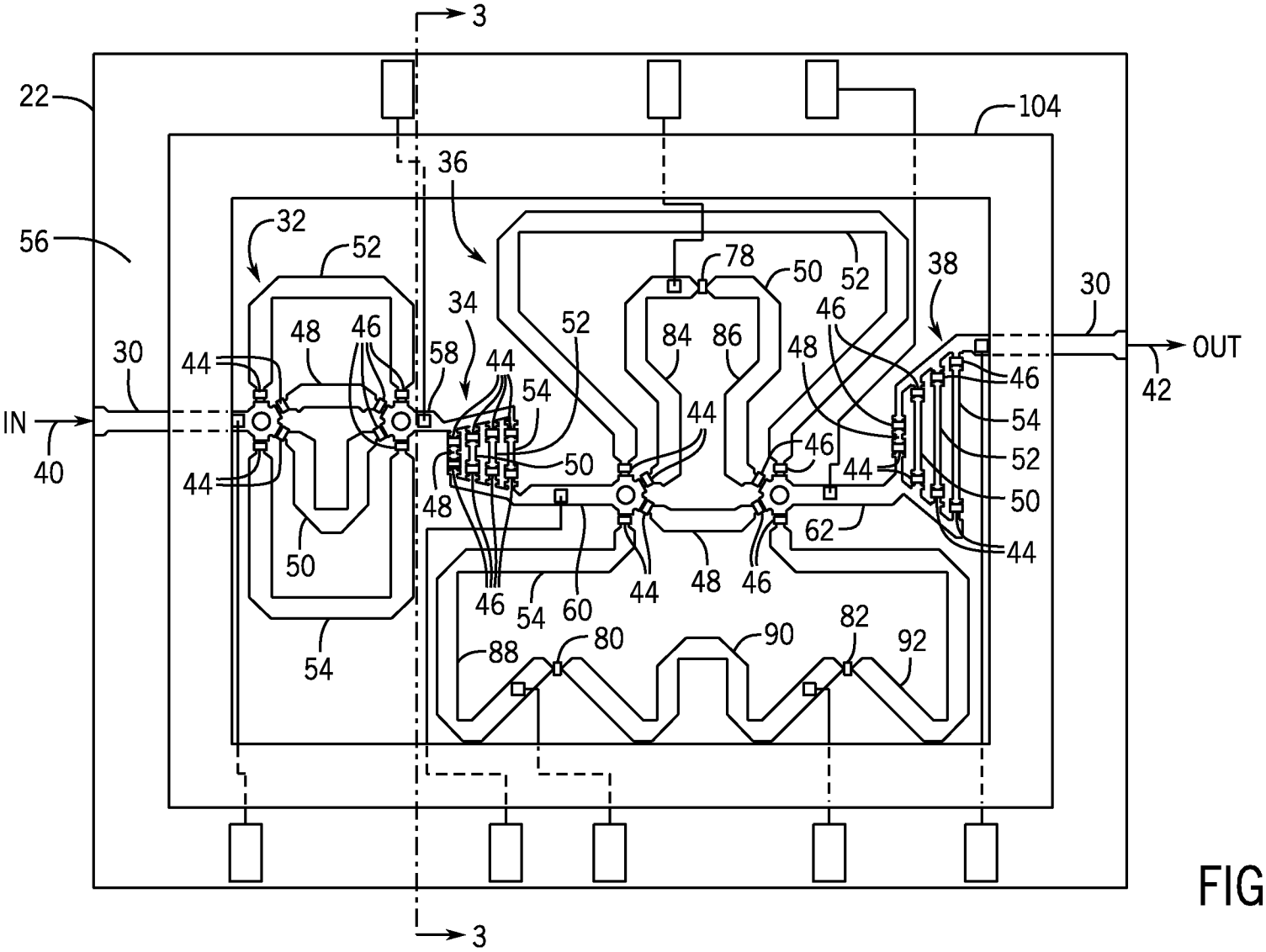
FIG. 2 is a schematic top view of a true time delay (TTD) module useable with the radar system of FIG. 1, according to one embodiment of the invention.

FIG. 2 is a schematic top view of a TTD module 22 incorporated in the radar system 10 of FIG. 1, according to one embodiment of the invention. The TTD module 22 includes a micro-strip transmission line 30 or signal line patterned on a base substrate 56 to include four (4) sets of time delay stages 32, 34, 36, 38. Micro-strip transmission line 30 is formed using a deposition, patterning, and/or etching technique as known in the art. In a preferred embodiment, base substrate 56 is formed of fused silica, which provides reduced current leakage and improved switch channel isolation. According to alternative embodiments, base substrate 56 may be an insulating, semi-insulating material, or semi-conductive material such as, but not limited to glass, alumina, quartz, polyimide, gallium arsenide, silicon, or germanium. Alternatively, base substrate 56 may be a semiconductor wafer processed to include switching elements or switches 44, 46 and micro-strip transmission line 30.

Micro-strip transmission line 30 may be any conductive material such as, for example, copper, gold, a tungsten/nickel/gold stack, or another common packaging material. As shown, micro-strip transmission line 30 is patterned such that the delay stages 32, 34, 36, 38 are serially connected, with the first delay stage 32 coupled to an RF signal input (IN) 40 of the TTD module 22 and the fourth delay stage 38 coupled to the RF signal output (OUT) 42 of the TTD module 22. Each of the delay stages 32, 34, 36, 38 includes an input electronic switching element 44 and an output electronic switching element 46 that are selectively controlled in either their on or off positions to insert a cumulative time delay in a transmission signal sent to the respective antenna element 14 (FIG. 1), as described in additional detail below. While elements 40 and 42 are described herein as input and output, respectively, it is contemplated that the functionality of elements 40, 42 might be reversed such that element 40 is an RF signal output and element 42 is an RF signal input. Similarly, it is to be understood that switching elements 44 and 46 function as respective "input" and "output" switching elements of respective delay lines 48, 50, 52, 54 when an RF signal travels through TTD module 22 from RF signal element 40 to RF signal element 42 and as "output" and "input" switching elements, respectively, when the signal travels in the reverse direction.

The first delay stage 32 includes four micro-strip delay lines 48, 50, 52, 54 patterned on the base substrate 56 of the TTD module 22. Delay lines 48, 50, 52, 54 have different lengths that impart different time delays to the RF input signal. Delay line 48 has a length L1, delay line 50 has a length L2, delay line 52 has a length L3, and delay line 54 has a length L4, with L1<L2<L3<L4. The phase of the transmission signal is shifted in proportion to the time delay imparted by the delay line 48, 50, 52, 54, with the longest delay line 54 imparting the greatest time delay.

The second, third, and fourth delay stages 34, 36, 38 are formed in a similar manner as the first delay stage 32, with each delay stage 34, 36, 38 including four micro-strip delay lines 48, 50, 52, 54 of varying lengths patterned on the base substrate 56. Line segments 58, 60, 62 (line segments 60, 62 also shown in FIG. 5) interconnect the delay stages 32, 34, 36, 38. Additional phase shift is imparted to the input signal by each subsequent delay stage 34, 36, 38 by selectively closing a given pair of switches 44, 46 on one of the four micro-strip delay lines 48, 50, 52, 54 while the remaining pairs of switches are maintained in an open position a similar manner as described above.

Switching devices 44, 46 are positioned on base substrate 56 at the terminal input and terminal output, respectively, of each micro-strip delay line 48, 50, 52, 54. In embodiments where switches 44, 46 are MEMS devices, the switches 44, 46 are formed using a build-up technique involving multiple deposition, anodization, patterning, and etching steps. In alternative embodiments, switching elements 44, 46 may be shunt switches, FET switches, or prefabricated switching elements coupled to base substrate 56 with a joining material such as an adhesive.

In the illustrated embodiment, the micro-strip delay lines 48, 50, 52, 54 of the first delay stage 32 and the third delay stage 36 are constructed having a star or fan out configuration and the micro-strip delay lines 48, 50, 52, 54 of the second delay stage 34 and the fourth delay stage 38 are constructed having a linear configuration. However, it is contemplated that the delay stages may be constructed having any number alternative configurations based on design specifications of a particular application.

The TTD module 22 disclosed herein is designed as a 256 state beam former, with four (4) delay stages, and a 360 degree delay/phase-shift range. TTD module 22 is operable over the entire Ku-band or over a 10-15 GHz bandwidth. However, it is contemplated that the concepts disclosed herein may be extended to TTD modules having any number of delay stages, with the number of delay stages and the length of the individual delay lines within those stages determined based on the desired amount of delay and resulting beam steering resolution for a particular application. Likewise, while the dimensions of TTD module 22 disclosed herein are approximately 9 mm by 7.5 mm, a skilled artisan will recognize that the dimensions of TTD module may be altered based on the design specifications of a particular application.

Figure 4:
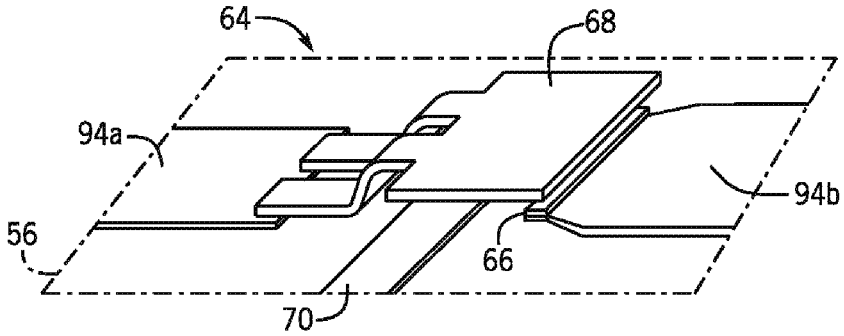
FIG. 4 is a schematic diagram of an exemplary electronic switching device usable in the TTD module of FIG. 2, according to one embodiment of the invention.

According to one embodiment of the invention, switches 44, 46 are provided as MEMS switches similar to MEMS switch 64 depicted in FIG. 4. MEMS switches 64 includes a contact 66 and a moveable element 68 such as for example, a cantilevered beam. In some embodiments, the moveable element 68 can be supported by an anchor, which may be integrated with the moveable element 68 and serve to connect the moveable element 68 to an underlying support structure such as base substrate 56. In the illustrated embodiment the moveable element 68 is a cantilevered beam that includes two cantilever portions connected to a common beam portion. However, it is contemplated that moveable element may be configured having alternative geometries in other embodiments. Contact 66, cantilevered beam 68, and electrode 70 are formed at least partially of at least one conductive material such as gold, gold alloy, nickel, nickel alloy, platinum, tantalum, and tungsten, as non-limiting examples. The switch 64 also includes an electrode or driving means 70 that effects a potential difference between the electrode 70 and the cantilevered beam 68.

As shown in FIG. 4, the contact 66 and moveable element 68 of MEMS switch 64 are formed between two micro-strip lines 94*a* and 94*b* patterned on base substrate 56, with the electrode 70 positioned between micro-strip lines 94*a* and 94*b*. MEMS switch 64 may be formed on base substrate 56 through a micro fabrication technique, such as, for example, vapor deposition, electroplating, photolithography, wet and dry etching, and the like, such that MEMS switch 64 constitutes a portion of a microelectromechanical device, nanoelectromechanical device, or MEMS. In such an embodiment, MEMS switch 64 is fabricating having features on the order of ones or tens of micrometers or nanometers.

When appropriately charged, the electrode 70 of MEMS switch 64 generates an electrostatic force that pulls the cantilevered beam 68 toward the electrode 70 and the contact 66. The electrode 70 thus acts as a gate with respect to the MEMS switch 64, causing the cantilevered moveable element 68 to move between a non-contacting or "open" position in which the moveable element 68 is separated from the contact 66 (shown in FIG. 4), and a contacting or "closed" position in which the moveable element 68 contacts and establishes electrical communication with the contact 66, thereby closing a circuit between micro-strip lines 94*a* and 94*b*.

Referring again to FIG. 2, switches 44, 46 of TTD module 22 are ohmic contact switch mechanisms similar to that shown in FIG. 4, in one embodiment of the invention. In alternative embodiments, TTD module 22 may include alternative types of MEMS switching devices, including capacitive contact or shunt switch mechanisms. Alternatively, it is contemplated that TTD module 22 may be fabricated with switching devices that employ other switch actuation techniques, including without limitation, thermal, piezoelectric, electromagnetic, gas bubble, Lorenz force, surface tension, combinations thereof, or any other actuation method known in the art.

Figure 5:
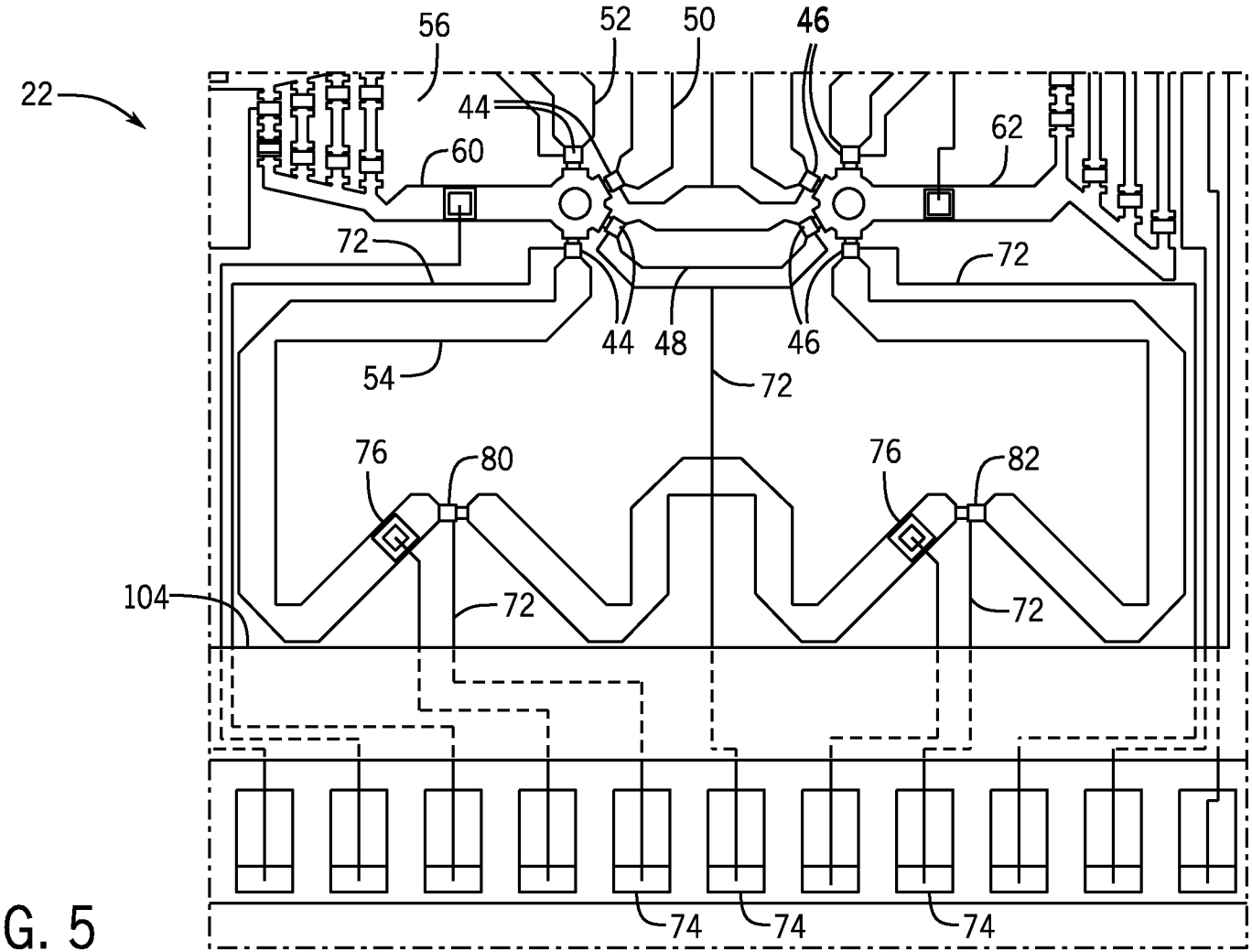
FIG. 5 is a schematic top view of a portion of a third delay stage of the TTD module of FIG. 2.

Still referring to FIG. 2 and with reference to the detailed view shown in FIG. 5 where appropriate, a given delay line, such as delay line 48 of the third delay stage 36 (FIG. 2) for example, is activated by closing the input switch 44 and output switch 46 on the delay line 48 while maintaining the switches 44, 46 on delay lines 50, 52, 54 in an open position. The MEMS switches 44, 46 of TTD module 22 are controlled to move between their open and closed positions by applying a selective gate voltage to the electrode 70 (FIG. 4) of the MEMS switch 44, 46. This gate voltage is provided through gating lines 72 patterned on the base substrate 56. Gating lines 72 (FIG. 5) electrically couple the MEMS switches 44, 46 to gate voltage sources or gate drivers 74 (FIG. 5). Similar to transmission line 30 (FIG. 2), gating lines 72 can be fabricated using micro-fabrication techniques such as, for example, vapor deposition, electroplating, photolithography, wet and dry etching, and the like.

Gate drivers 74 and their corresponding gating lines 72 (FIG. 5) are omitted from FIG. 2 for purposes of clarity. However, it will be understood that each of the MEMS switches 44, 46 of TTD module 22 is coupled to respective gating lines and drivers in a similar manner as illustrated in FIG. 5. The TTD module 22 also includes power sources 76 (FIG. 5) that are coupled to the micro-strip lines and establish a potential difference between the contact 66 and the cantilevered beam 68 of the MEMS switches 44, 46 when the switch is in the open position.

In addition to switches 44, 46 provided at the input end and output end of each delay line 48, 50, 52, 54, the third delay stage 36 includes a number of intermediate switching elements 78, 80, 82 provided along the length of delay line 50 and delay line 54. Intermediate switching element 78 (FIG. 2) is positioned on the second delay line 50 of the third delay stage 36. Intermediate switching elements 80, 82 are positioned on the fourth delay line 54 of third delay stage 36. Similar to switches 44, 46, intermediate switching elements 78, 80, 82 are MEMS switches that are formed atop base substrate 56 using a multi-stage build up technique in a preferred embodiment. However, intermediate switching elements 78, 80, 82 may be provided as any of the other types of switch elements described above in alternative embodiments.

Intermediate switching elements 78, 80, 82 are coupled to respective gate drivers 74 and gated in a similar manner as described above with respect to switches 44, 46 in order to control switching elements 78, 80, 82 between an open position and a closed position. In one embodiment, the MEMS switches 44, 46 positioned at the input end and output end of a particular delay line and any intermediate switching element(s) on the particular delay line may be coupled to individual gate drivers that are controlled to cause the input switch 44, output switch 46, and any intermediate switches 78, 80, 82 to open or close simultaneously. The MEMS switches 44, 46 on delay line 48 of the third delay stage 36 of TTD module 22 are configured in this manner, as shown in FIG. 4. Alternatively, the gate control lines for the input switch, output switch, and any intermediate switches may be ganged together and coupled to a common gate driver 74 to be opened or closed simultaneously.

When switching element 78 is in the open position, the second delay line 50 is divided into two separate line segments 84, 86 as shown in FIG. 2. Likewise, intermediate switching elements 80, 82 divide the fourth delay line 54 into three separate line segments 88, 90, 92 as shown in FIG. 2 when in an open position. The length of each of the individual line segments 84, 86, 88, 90 and 92 is less than a half wavelength or a quarter wavelength in alternate embodiments. As used herein the terms "half wavelength" and "quarter wavelength" refer to the effective wavelength of a frequency range of the RF input signal taking into account the insulating or dielectric materials and capping materials provided with TTD module 22. By effectively reducing the length of delay lines 50, 54 into individual line segments 84, 86, 88, 90 and 92 that are shorter than a half wavelength or a quarter wavelength, the resonant frequency of delay lines 50, 54 is pushed higher than the frequency band of interest. Energy suck-out resulting from inter delay line coupling or crosstalk between the active signal transmission line to the non-active neighborhood lines is significantly reduced in comparison to an equivalent 256 TTD module manufactured without intermediate switching elements. In one exemplary embodiment, the inter delay line coupling or cross talk of TTD module 22 is less than 25 dB.

Figure 6:
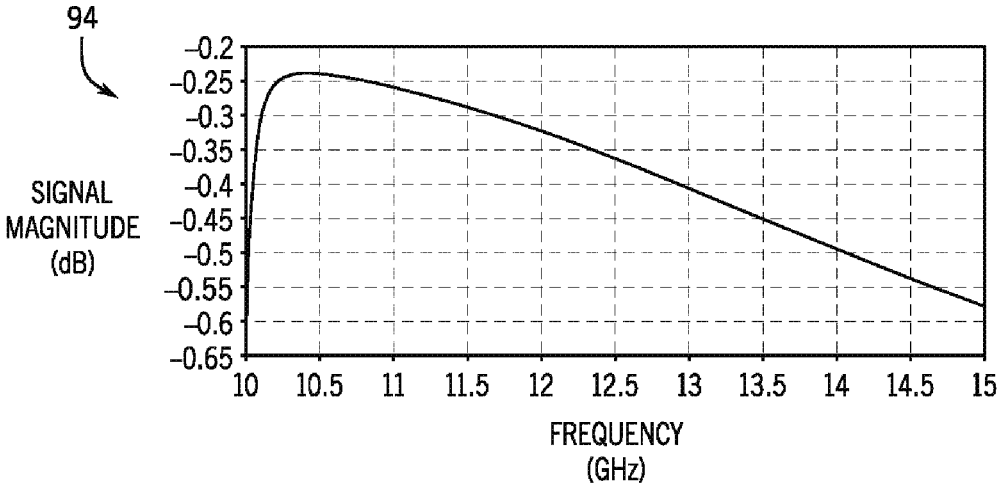
FIG. 6 is an S-parameter graph for the TTD module shown in FIG. 2, according to an exemplary embodiment of the invention.
Figure 7:
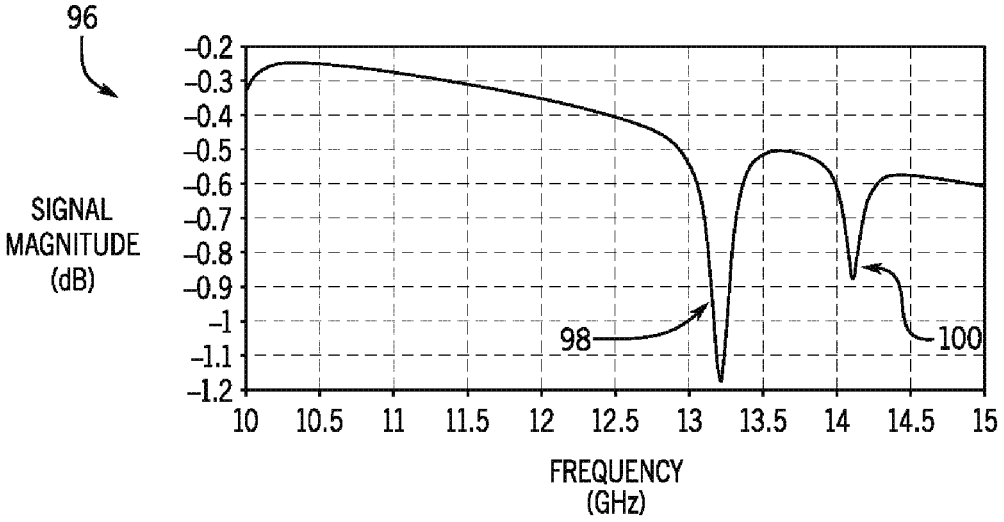
FIG. 7 is an S-parameter graph for a TTD module manufactured without intermediate switching elements.

The benefit of including intermediate switching elements 78, 80, 82 on delay lines 50, 54 shown in FIG. 2 is graphically depicted in FIGS. 6 and 7, which show signal magnitude in dB with respect to frequency in GHz. FIG. 6 is an exemplary S-parameter graph 94 for the TTD module 22 of FIG. 2, showing performance of the TTD module 22 over a 10-15 GHz operating frequency band with the signal controlled to pass through the shortest delay line 48 of the third delay stage 36. FIG. 7 illustrates related art of an exemplary S-parameter graph 96 of a TTD module structurally identical to the TTD module 22 of FIG. 2 except for the omission of intermediate switching elements 78, 80, 82. As shown in FIG. 7, without intermediate switching elements 78, 80, 82, the TTD module 22 exhibits a signal magnitude in dB having two resonances in the 10-15 GHz operating frequency band when the signal is controlled to pass through the shortest delay line 48 of the third delay stage 36: a first resonance 98 at 13 GHz and a second resonance 100 at 14 GHz. Inclusion of intermediate switching elements 78, 80, 82 in TTD module 22 eliminates these suck-out resonances or bandstop resonances in the transmission line, as seen by the antenna factor curve 94 of FIG. 6.

Figure 3:
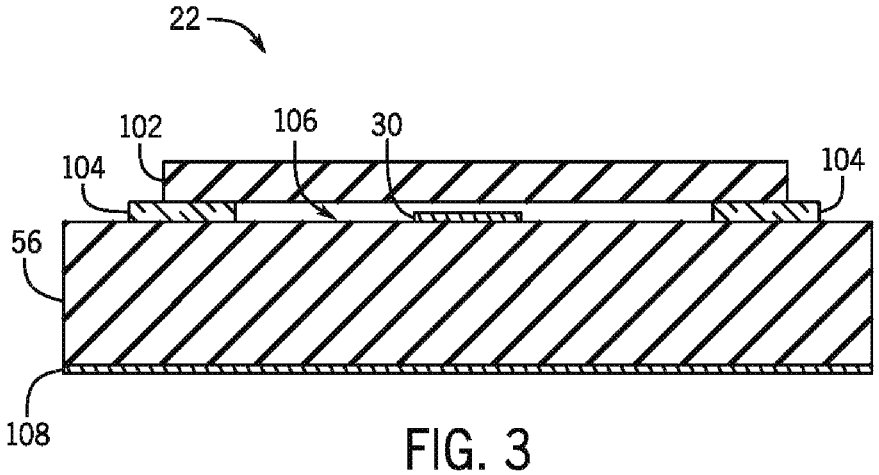
FIG. 3 is a cross sectional view of the TTD module of FIG. 2 taken along line 3-3.

Referring now to FIG. 3, TTD module 22 further includes a protective cap 102 or lid, which is omitted from FIG. 2 for purposes of illustrating the underlying micro-strip transmission line 30. After the micro-strip transmission line 30 and switching elements 44, 46, 78, 80, 82 (FIG. 2) are formed on base substrate 56, the cap 102 is bonded to the base substrate 56 with an intervening layer of sealing material 104 (also shown in FIGS. 2 and 5) such as, for example, solder, glass frit, or gold. The four first delay stages 32, 34, 36, 38 and associated switching elements 44, 46, 78, 80, 82, as shown in FIG. 2, are enclosed and vacuum or hermetically sealed within a cavity 106 formed between cap 102 and base substrate 56. Cavity 106 may be filled with a dielectric medium such as, for example, but not limited to air or a dielectric gas such as nitrogen. TTD modules 22 including cap 102 may be packaged as individual modules corresponding to each antenna element 14 or as a wafer-level package including multiple TTD modules 22 sealed within a wafer-level cap (not shown).

The illustrated TTD module 22 is configured with an embedded micro-strip configuration in which a ground layer 108 is provided below the base substrate 56 as shown in FIG. 3. However, it is contemplated that TTD module 22 may be fabricated having alternative grounding configurations, such as, for example a grounded coplanar waveguide configuration wherein two ground lines (not shown) are provided coplanar to the micro-strip transmission line 30 on the base substrate 56. In yet another alternative embodiment, TTD module 22 is constructed with an inverted ground plane (not shown) that is positioned above the anchor 30 and base substrate 56 in a similar manner as described in Ser. No. 14/839,402 (U.S. Pat. No. 9,570,783, issued Feb. 14, 2017), which is incorporated by reference in its entirety. In such an embodiment, the width, length, and routing pattern of the transmission line 30 may be altered and the overall die size would be reduced.

Beneficially, embodiments of the invention thus provide a TTD beam forming module for broadband frequency signal processing applications. The TTD beam forming module includes one or more intermediate switching devices that are selectively placed along one or more delay lines within the TTD module. When controlled in an open or non-active position, these intermediate switching devices divide a given delay line into individual line segments, each having a length of less than a quarter wavelength or a half wavelength according to alternative embodiments. By reducing an otherwise relatively long delay line into individual, shorter segments, the resonant frequency of the delay line is pushed higher than the frequency band of interest and electromagnetic coupling between the active transmission line and the neighboring longer non-active transmission line is avoided.

According to one embodiment of the invention, a true time delay (TTD) module includes a substrate and a transmission line formed on the substrate. The transmission line includes a plurality of time delay lines that define signal paths of varying lengths between a signal input of the TTD module and a signal output of the TTD module. A plurality of switching elements are positioned along the transmission line and are selectively controllable to define a signal transmission path between the signal input and the signal output. The plurality of switching elements include an input switching element positioned at a first end of each of the plurality of time delay lines, an output switching element positioned at a second end of each of the plurality of time delay lines, and at least one intermediate switching element positioned between the input switching element and the output switching element of at least one of the plurality of time delay lines.

According to another embodiment of the invention, a method of manufacturing a true time delay (TTD) module includes patterning a signal line on a substrate, the signal line comprising a plurality of delay lines defining alternative paths between a signal input and a signal output of the TTD module. The method also includes forming a first switching device at an input end of each of the plurality of delay lines and forming a second switching device at an output end of each of the plurality of delay lines. At least one intermediate switching device is formed on at least one of the plurality of delay lines between the first switching device and the second switching device. The at least one intermediate switching device divides the respective delay line into a plurality of electrically isolated segments when the at least one intermediate switching device is in an OFF state.

According to yet another embodiment of the invention, a beam forming system includes an antenna comprising a plurality of antenna elements and a plurality of dies constructed to transmit a true time delayed (TTD) signal to the plurality of antenna elements. Each die of the plurality of dies includes a base substrate, a transmission line formed on the base substrate, a pair of switching elements positioned at opposing ends of each of the plurality of delay lines, and an intermediate switching element positioned on at least one of the plurality of delay lines between a respective pair of switching elements. The transmission line includes a plurality of delay lines defining alternative signal paths between a signal input and a signal output of the die. The intermediate switching element divides the respective delay line into a plurality of electrically isolated segments when the intermediate switching element is in an open position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A true time delay (TTD) module comprising:

a substrate;

a transmission line formed on the substrate, the transmission line comprising a plurality of time delay lines defining signal paths of varying lengths between a signal input of the TTD module and a signal output of the TTD module; and a plurality of switching elements positioned along the transmission line and selectively controllable to define a signal transmission path between the signal input and the signal output, the plurality of switching elements comprising:

an input switching element positioned at a first end of each of the plurality of time delay lines;

an output switching element positioned at a second end of each of the plurality of time delay lines;

at least one intermediate switching element positioned between the input switching element and the output switching element of at least one of the plurality of time delay lines; and wherein the at least one intermediate switching element divides a respective time delay line of the plurality of time delay lines into a plurality of line segments, each line segment having a length of less than a half wavelength of a frequency range of an RF input signal.

2. The TTD module of claim 1 wherein the transmission line comprises an embedded micro-strip configuration.

3. The TTD module of claim 1 wherein the plurality of switching elements comprise micro-electromechanical systems (MEMS) switches.

4. The TTD module of claim 1 wherein the plurality of time delay lines define 256 states.

5. The TTD module of claim 1 wherein the plurality of time delay lines comprise:

a first set of time delay lines defining a first time delay stage of the TTD module; and at least a second set of time delay lines defining subsequent time delay stages of the TTD module.

6. The TTD module of claim 1 further comprising a gate driver configured to simultaneously send a control signal to the least one intermediate switching element, the input switching element, and the output switching element on a respective time delay line of the at least one of the plurality of time delay lines.

7. The TTD module of claim 1 further comprising a lid coupled to the substrate; and wherein the plurality of time delay lines are hermetically sealed within a cavity formed between the lid and the substrate.

8. The TTD module of claim 1 wherein the at least one intermediate switching element is positioned on a respective time delay line of the plurality of time delay lines having a length of at least a half wavelength of the frequency range of the RF input signal.

9. The TTD module of claim 1 wherein the at least one intermediate switching element reduces electrical coupling between the plurality of time delay lines of a time delay stage to less than 25 dB.

10. The TTD module of claim 1 wherein the length of each line segment of the plurality of line segments is less than a quarter wavelength of the frequency range of the RF input signal.

11. The TTD module of claim 1 wherein the at least one intermediate switching element eliminates a bandstop resonance in the transmission line.

12. A true time delay (TTD) module comprising:

a substrate;

a transmission line formed on the substrate, the transmission line comprising a plurality of time delay lines defining signal paths of varying lengths between a signal input of the TTD module and a signal output of the TTD module; and a plurality of switching elements positioned along the transmission line and selectively controllable to define a signal transmission path between the signal input and the signal output, the plurality of switching elements comprising:

a respective input switching element positioned at a first end of each of the plurality of time delay lines;

a respective output switching element positioned at a second end of each of the plurality of time delay lines;

at least one intermediate switching element positioned between the respective input switching element and the respective output switching element of at least one of the plurality of time delay lines; and wherein the at least one intermediate switching element reduces electrical coupling between the plurality of time delay lines of a time delay stage to less than 25 dB.

13. A method of manufacturing a true time delay (TTD) module comprising:

patterning a signal line on a substrate, the signal line comprising a plurality of delay lines defining alternative paths between a signal input and a signal output of the TTD module;

forming a first switching device at an input end of each of the plurality of delay lines;

forming a second switching device at an output end of each of the plurality of delay lines;

forming at least one intermediate switching device on at least one of the plurality of delay lines between the first switching device and the second switching device, the at least one intermediate switching device dividing the respective delay line into a plurality of electrically isolated segments when the at least one intermediate switching device is in an OFF state; and wherein patterning the signal line further comprises:

patterning a first plurality of the plurality of delay lines to define a first time delay stage having a fan configuration; and patterning a second plurality of the plurality of delay lines to define a second time delay stage having a linear configuration.

14. The method of claim 13 wherein forming the first, second, and at least one intermediate switching devices comprises forming micro-electromechanical systems (MEMS) switches on the substrate.

15. The method of claim 13 wherein forming the at least one intermediate switching device comprises:

forming a first intermediate switching device on one of the plurality of delay lines; and forming at least another intermediate switching device on another of the plurality of delay lines.

16. The method of claim 13 further comprising positioning the at least one intermediate switching device on a respective delay line having a length of one of a half wavelength and a quarter wavelength.

17. A true time delay (TTD) module comprising:

a substrate;

a transmission line formed on the substrate, the transmission line comprising a plurality of time delay lines defining signal paths of varying lengths between a signal input of the TTD module and a signal output of the TTD module; and a plurality of switching elements positioned along the transmission line and selectively controllable to define a signal transmission path between the signal input and the signal output, the plurality of switching elements comprising:

a respective input switching element positioned at a first end of each of the plurality of time delay lines;

a respective output switching element positioned at a second end of each of the plurality of time delay lines;

at least one intermediate switching element positioned between the respective input switching element and the respective output switching element of at least one of the plurality of time delay lines; and wherein the at least one intermediate switching element eliminates a bandstop resonance in the transmission line.

18. A beam forming system comprising:

an antenna comprising a plurality of antenna elements; and a plurality of dies constructed to transmit a true time delayed (TTD) signal to the plurality of antenna elements;

wherein each die of the plurality of dies comprises:

a base substrate;

a transmission line formed on the base substrate, the transmission line comprising a plurality of delay lines defining alternative signal paths between a signal input and a signal output of the die;

a plurality of switching element pairs, each switching element pair comprising a pair of switching elements positioned at opposing ends of a respective delay line of the plurality of delay lines; and an intermediate switching element positioned on a first delay line of the plurality of delay lines between the respective pair of switching elements positioned at opposing ends of the first delay line, wherein the intermediate switching element divides the first delay line into a plurality of electrically isolated segments when the intermediate switching element is in an open position; and wherein the intermediate switching element divides the first delay line into a plurality of line segments, each line segment having a length of less than a half wavelength of a frequency range of an RF input signal.

19. The beam forming system of claim 18 wherein the respective pairs of switching elements and the respective intermediate switching elements comprise micro-electromechanical systems (MEMS) switches.

20. The beam forming system of claim 18 wherein the plurality of dies comprise multi-stage TTD modules operable over a 10-15 GHz bandwidth.

* * * * *